United States Patent [19]

Hodges

[11] Patent Number: 4,625,658

[45] Date of Patent: Dec. 2, 1986

[54] SAFETY STORAGE APPARATUS

[76] Inventor: Robert M. Hodges, 3720 Hampton Rd., Pasadena, Calif. 91107

[21] Appl. No.: 621,158

[22] Filed: Jun. 15, 1984

[51] Int. Cl.[4] ..... E05G 1/00

[52] U.S. Cl. ..... 109/47; 109/52; 109/35; 109/73

[58] Field of Search ..... 109/38, 39, 24.1, 59 R, 109/49.5, 45, 47, 35, 87, 73; 70/333

[56] References Cited

U.S. PATENT DOCUMENTS

| | | | |
|---|---|---|---|
| 1,461,963 | 7/1923 | Bieneck | 109/45 |
| 4,022,137 | 5/1977 | Chiu | 109/47 |
| 4,369,717 | 1/1983 | Bollier | 109/45 |

FOREIGN PATENT DOCUMENTS

| | | | |
|---|---|---|---|
| 1465133 | 1/1966 | France | 109/45 |
| 407512 | 8/1966 | Switzerland | 109/45 |

*Primary Examiner*—Gary L. Smith
*Assistant Examiner*—Neill Wilson
*Attorney, Agent, or Firm*—William W. Haefliger

[57] ABSTRACT

A safe or safety storage apparatus is mounted for vertical up and down movement above and below a concrete slab. An actuator is provided to effect the movement and a lock is provided to hold the apparatus in the down position. A closure is provided that moves with and covers the apparatus when it is in the down position.

18 Claims, 5 Drawing Figures

SAFETY STORAGE APPARATUS

BACKGROUND OF THE INVENTION

This invention relates generally to safe storage of valuables or other articles, and more particularly to apparatus which is virtually inaccessible, or inaccessible to intruders, even if they somehow discover the location of the apparatus.

There is continuing need for apparatus as referred to above. Wall safes and other conventional "safe" storage devices in homes and buildings do not provide the required inaccessibility since they are:

(a) relatively easy to discover or locate, and (b) are relatively easily accessed when discovered.

SUMMARY OF THE INVENTION

It is a major abject of the invention to provide a solution to the above problem. Basically, the invention is adapted for combination with a concrete or other floor slab having a vertical access opening therethrough, and comprises:

(a) a vertical actuator beneath said opening, (b) a safe storage chamber mounted on said actuator for vertically actuated movement via said opening between a stored position below the level of said slab and an access position above the level of said slab, and (c) a closure overlying said storage chamber for vertical movement therewith between a down position closing said opening and an up position above said chamber in its said access position.

Further objects of the invention include the provision of a lifting element above the safe chamber and concealed by the closure, that element being liftable to elevate the chamber independently of operation of the acutator; the provision of a closure, as referred to, consisting of concrete, and partial concealment of the lifting element in that concrete closure; the provision of a protective shield that blocks access to the opening in the floor slab when the safe chamber is elevated; and the provision of electrified wiring to mask the location of the metallic safe chamber under the slab, through attempted use of metal detectors.

Additional objects include the provision of latch means, as for example a solenoid, to block vertical movement of the safe chamber until unlatched, as via central circuitry (including optional input code responsive circuitry) and as via mechanical unlatching means, all suitably concealed, as will appear.

These and other objects and advantages of the invention, as well as the details of an illustrative embodiment, will be more fully understood from the following specification and drawings, in which:

DRAWING DESCRIPTION

DETAILED DESCRIPTION

Figures 1, 2:
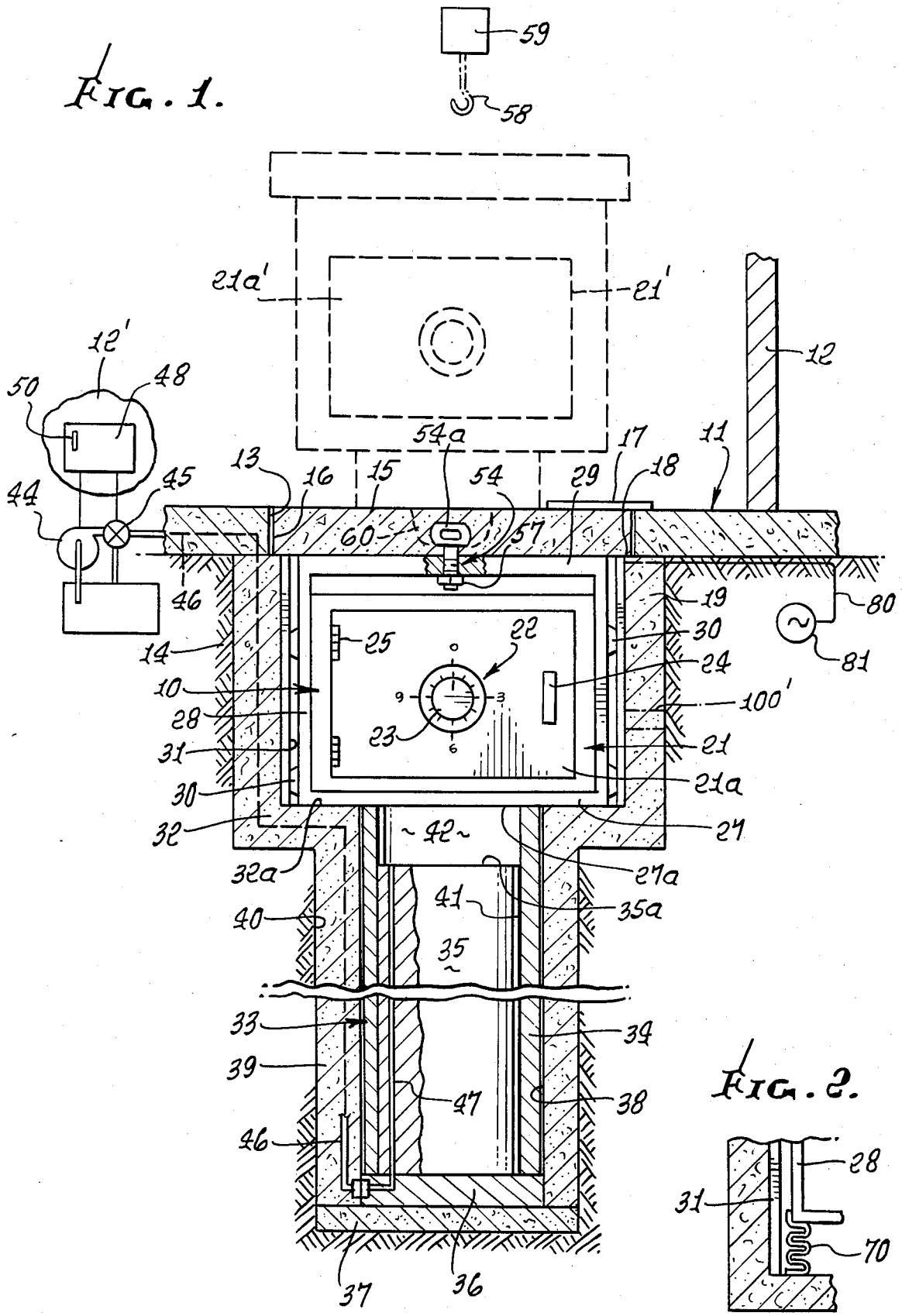
FIG. 1 is an elevation, partly in section, showing details of the safety storage apparatus of the invention.
FIG. 2 is a fragmentary elevation showing a modification.

Referring to the drawing, the safety storage apparatus 10 is shown installed for, and in combination with, a concrete slab 11 associated with a dwelling or building having a wall 12, for example. Floor slab 11 may be the basement of such a building, and it has a vertical accesss opening 13 therethrough, the opening typically being rectangular. The formation 14 below the slab is excavated to permit installation of apparatus 10, below opening 13. The latter is closed by a closure 15, which may comprise a sub-slab of concrete peripherally fitting closely to the walls of the opening 13, as at location 16, whereby to the observer standing on the slab 11 it is not immediately clear that the sub-slab or closure 15 is distinct from the slab 13. A floor covering 17 (tile, plaster, etc.) may be installed over the interfit locus 16 to conceal it. the lower periphery **15*a* of the sub-slab 15 may rest on a ledge 18 provided by concrete enclosure walls 19 formed below the slabs to provide an enclosed space 20**.

Located within space 20 is a safe storage chamber 21 in the form, for example, of a steel-walled, rectangular box or safe, having a steel door **21*a*. A combination lock 22 is carried by the door so that it can be opened only by correct rotary manipulation of the combination knob 23. A door handle appears at 24, and hinges at 25**. These safe chamber elements may be conventional.

A heavy duty frame 26 is located about the chamber 21, and includes bottom support 27, side support 28 and top support 29. Frame 26 may consist of steel. It carries laterally projecting slippers or spacer bearings 30 which slide against the vertical guides 31 (for example steel) at the lower sides of walls 19, whereby vertical movement of the heavy duty frame and safe chamber 21, within the concrete enclosure walls 19, occurs. Frame bottom support 27, which carries the safe chamber, is shown seated against top surface **32*a* of concrete ledge 32 projecting inwardly at the lower terminus of wall or walls 19**.

Extending beneath the frame and safe chamber is a vertical actuator 33. It includes a vertical steel cylinder 34 and a vertical piston 35 with respect to which the cylinder is vertically movable to lift and lower the frame and safe chamber. Thus, for example, the lower end of the piston may be anchored to a base plate 36 seated on concrete foundation 37, and the cylinder 34 is movable up and down within bore 38 formed by concrete shell 39, in spaced relation to that bore. Shell is received in pit 40 dug in formation 14. The piston and cylinder have slidable interengagement at 41, and a pressure fluid receiving space 42 is formed within the cylinder 34 and between the top **35*a* of the piston and the bottom 27*a* of frame plate 27 to which the cylinder is attached at 43. Pressure fluid is supplied to space 42 as via pump 44, valve 45, and, fluid line 46 and 47, the pump motor and valve being suitably actuated and controlled as indicated at 48**.

The safe chamber 21 may, accordingly, be moved between a down-position, as indicated by full lines in FIG. 1, in which the access opening 13 is closed by sub-slab 15, and an up-position as indicated by broken lines 21', in which the safe chamber, combination 22' and door **21*a*' are fully accessible to a person standing or kneeling on slab 11. Normally, controls 48 operable to lift and lower the safe-chamber are hidden, as in a building wall indicated at 12'. Controls 48 can furthermore be secured as by requiring key entry at 50** prior to their being operable.

A further important feature of the invention is the provision of a lifting element above the chamber and concealed by closure slab 15, that element being liftable to elevate the safe chamber (for access to the safe) independently of operation of the vertical actuator 33 as described. In this regard, the lifting element may advantageously extend into the concrete closure 15 for absolute concealment, and to be accessible only after destruction of that portion of the slab closure 15 closest to the element.

In the example, the lifting element comprises a fastener 54 having an enlarged head **54*a* embedded in the concrete of the closure, the fastener also having a shank 54*b* threadably (or otherwise) attached to the frame 26, as via top support 29, as shown. See for example nut 57 on the fastener shank, and tightened against the bottom of support 29. The fastener head 54*a* may be looped or hooked, to enable connection of an auxiliary lifter hook 58, or the like, powered at 59. Note the possible destruction area around the fastener head, indicated by broken lines 60, and which enables access of hook 58 to the fastener head, for lifting the frame, safe-chamber, and sub-slab 15. Such operation would be possible in the event of mal-function of the fluid actuator apparatus 33, or loss of the access key to control 48**.

FIG. 2 shows an example of a modification wherein shield means is provided, and located to be brought into position to block access to the floor opening 13 in response to elevation of the closure to up-position. The shield means is shown in the form of a skirt 70 movable upwardly with chamber 21 and depending relative thereto, as from the frame side supports 28. The skirt hangs down to, or into, the opening 13 when the safe chamber is in up position. In down position the skirt is stored, as by bellows collapse, as shown. Other shield protectors may be employed.

Finally, electrical wiring 80 may extend laterally of the pit or storage chamber as directly under slab 11, and in multiple directions, to produce an electrical field extending above the slab, when the safe chamber is in down position. That field, extending in all directions, masks the location of the steel safe chamber as against detection by use of metal sensors or detectors, above the slabs 11 and 15. A source of electical current for such wiring appears at 81.

Figure 3:
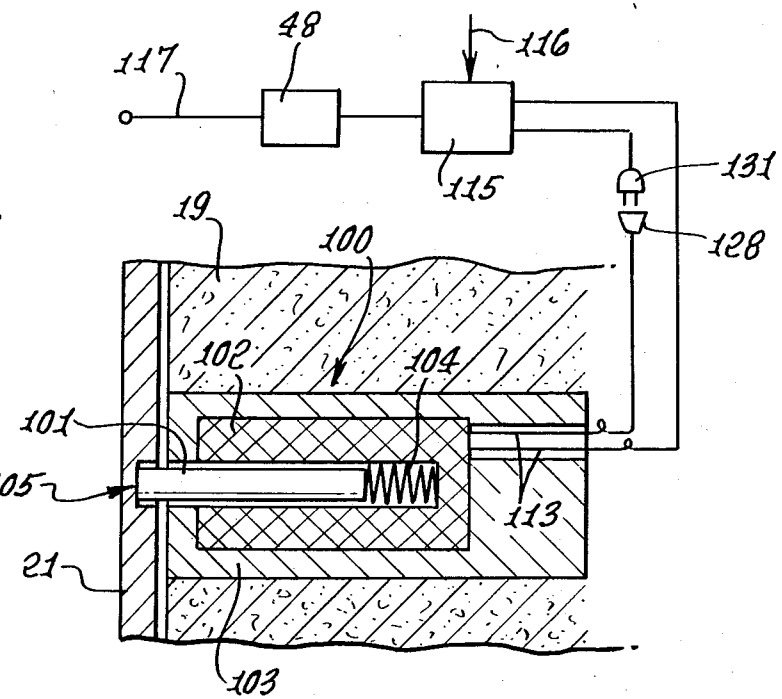
FIGS. 3 and 4 are vertical sections showing alternative solenoids.
Figure 4:
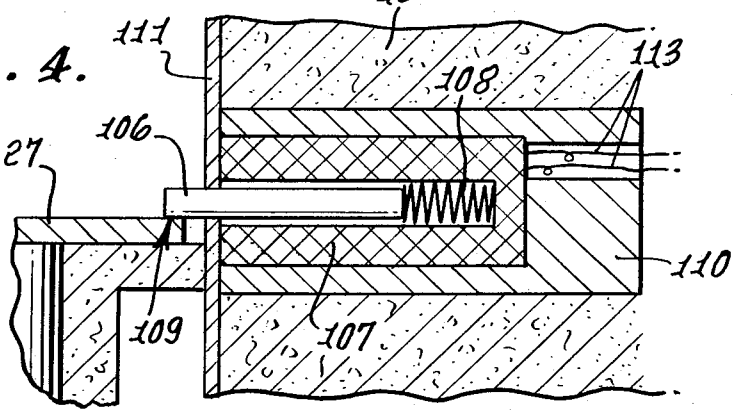

FIG. 3 illustrates one form of electrically operable latch means 100 located below the level of the closure opening for blocking vertical movement of the storage chamber 21. See also locus 100' in FIG. 1. the latch means may advantageously include a solenoid having a plunger or armature 101 and a coil 102, within a housing 103. A spring 104 normally urges the plunger into latching relation, as at 105, with the wall of chamber 21. Housing 103 may be located in concrete wall 19. FIG. 4 shows an alternative solenoid design, with armature 106 and coil 107. Spring 108 normally urges armature 106 into latching relation with base plate 27, as at 109. Note solenoid steel housing 110 and steel face plate 111.

Electrical energization of the solenoid coils retracts the armature to release the safe 21, or base plate 27, for vertical movement. Power conduits to the solenoids appear at 113. FIG. 3 also shows a power source 117, as for example AC supplied from the surface or via control unit 48 as referred to above, to control release of the latch and allow vertical movement of the safe, as via the elevation means described above. If desired, a coded input responsive circuit 115 may be operatively connected in series with the solenoid (see FIG. 3 for example) to enable electrical operation of the solenoid only after predetermined electrically coded input (represented at 116) to circuitry 115. Such coding and input 116 may take various known forms (PCM, magnetic, etc.). Devices 48 and 115 may be suitably concealed.

Figure 5:
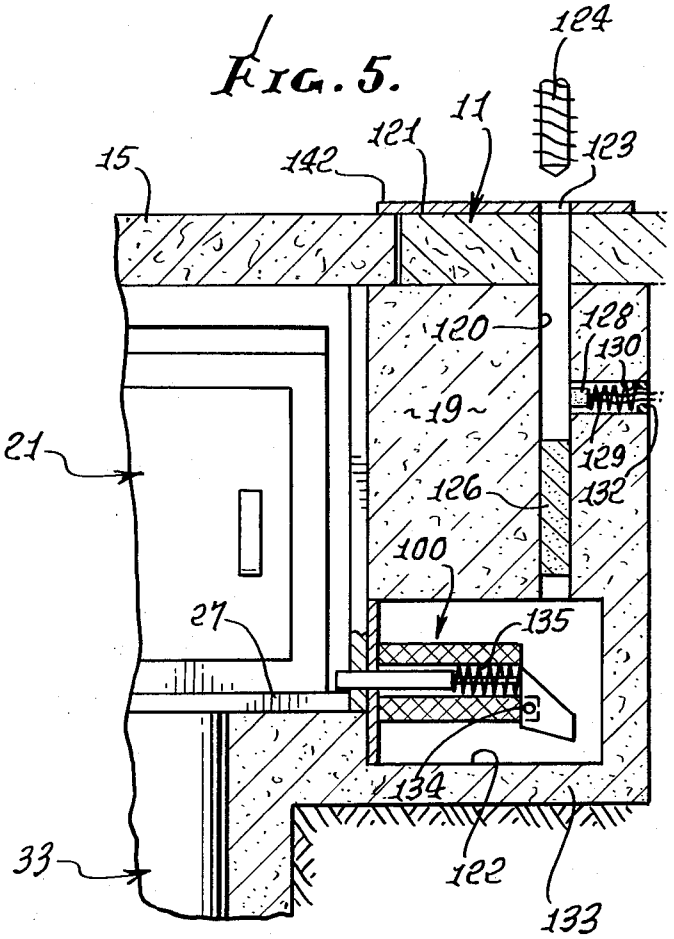
FIG. 5 is a view like FIGS. 3 or 4, showing greater detail.

Referring now to FIG. 5, the latch means 100 may include one of the above discussed solenoids, as for example that of FIG. 4. Also provided is means (as for example concrete wall 19) forming an access opening 120 extending downwardly (as from a point below the surface 121 of slab 11) to the solenoid cavity 122. Thus, the location of the avenue or opening 120 is masked on by material between the top of the opening and the surface of slab 11, for example. Item 142 indicates a template which, when properly oriented relative to and above the closure 15, reveals the location of the access opening 120. See for example opening 123 in the template directly above opening 120. A drill or other tool may then be employed (as indicated at 124) to drill down through the concrete and into guide opening 120, to drill out fill material 126 therein.

An electrical connection such as a jack 128 may be associated with opening 120 for reception of electrical power via the upper extent of opening 120, for operating the solenoid to unblock vertical movement of the safe chamber. Thus, jack 128 may be displaced lateraly, by spring 129 in lateral underground hole 130, and into position in access opening 120 to receive electrical plug 131 (see also FIG. 3) inserted down hole 120. Wiring from the jack to the solenoid is indicated at 132.

In the event of electrical power failure, the solenoid latch may be released mechanically. Thus opening 120 extends downwardly to the vicinity of a latch release element 133 pivotally supported at 134 and connected to armature 101 or 106 as via rod 135. When tool 124 is displaced downwardly sufficiently in opening 120, it displaces or swings element 133 downwardly, retracting the latch mechanically, and releasing the safe chamber for upward movement.

I claim:

1. Safety storage apparatus adapted for combination with a concrete slab having a vertical access opening therethrough, comprising (a) a vertical actuator beneath said opening, (b) a safe storage chamber mounted on said actuator for vertically actuated movement via said opening between a stored position below the level of said slab and an access position above the level of said slab, (c) a closure overlying said storage chamber for vertical movement therewith between a down position closing said opening and an up position above said chamber in its said access position, and (d) a lifting element above said chamber and concealed by said closure, said element being liftable to elevate said chamber independently of operation of the acutator, said closure consisting of concrete sized for close reception in said opening, said lifting element extending into said concrete closure to be accessible after destruction of that portion of the concrete closest to said element.

2. The combination of claim 1 wherein said storage chamber comprises a safe having a combination controlled door lock.

3. The combination of claim 1 wherein said element comprises a fastener having an enlarged head in said closure, there being a frame mounted on said actuator and supporting the storage chamber, said fastener attached to said frame.

4. The combination of claim 1 wherein said actuator includes piston and cylinder components, the cylinder movable upwardly in response to fluid pressure supply to the actuator above the piston, the actuator installed in a sub-surface formation.

5. The combination of claim 1 including shield means located to be brought into position to block access to said opening in response to elevation of said closure to said up position.

6. The combination of claim 5 wherein said shield means comprises a skirt movable upwardly with said chamber and depending relative thereto.

7. The combination of claim 3 including guides on said frame to engage auxiliary structure laterally of the chamber during vertical movement thereof, and below the level of said slab.

8. Safety storage apparatus adapted for combination with a concrete slab having a vertical access opening therethrough, comprising (a) a vertical actuator beneath said opening, (b) a safe storage chamber mounted on said actuator for vertically actuated movement via said opening between a stored position below the level of said slab and an access position above the level of said slab, (c) a closure overlying said storage chamber for vertical movement therewith between a down position closing said opening and an up position above said chamber in its said access position, and (d) including electrical wiring extending laterally of said storage chamber and also electrically connected thereto when the chamber is in said stored postion whereby AC current in said wiring will establish an electrical field at and laterally of said chamber to mask its position against detection by use of electrical sensors above said slab.

9. The combination of claim 1 including said concrete slab having said access opening therethrough.

10. The combination of claim 9 including a floor covering over said slab and said closure which closely fits said access opening.

11. The combination of claim 1 including electrically operable latch means located below the level of said opening for blocking said vertical movement of the storage chamber to said up position.

12. The combination of claim 11 including control means for controlling release of said latch means to allow said vertical movement.

13. The combination of claim 12 wherein the operation of said control means is carried out from above the level of said closure.

14. The combination of claim 11 wherein said latch means includes a solenoid having a plunger normally extending in blocking relation to said vertical movement of the storage chamber, and having circuitry to retract the plunger in response to operation of said control means.

15. Safety storage apparatus adapted for combination with a concrete slab having a vertical access opening therethrough, comprising (a) a vertical actuator beneath said opening, (b) a safe storage chamber mounted on said actuator for vertically actuated movement via said opening between a stored position below the level of said slab and an access position above the level of said slab, (c) a closure overlying said storage chamber for vertical movement therewith between a down position closing said opening and an up position above said chamber in its said access position, (d) electrically operable latch means located below the level of said opening for blocking said vertical movement of the storage chamber to said up position, (e) and a latch release element operatively connected to the latch to effect unblocking movement of the latch in response to displacement of said release element when accessed as via an accessing tool and means forming an access opening extending downwardly to said release element, the location of said opening being masked.

16. The combination of claim 15 including a template which, when oriented relative to and above said closure, reveals the location of said access opening, whereby a latch element release device may be inserted in said opening.

17. The combination of claim 15 wherein said latch means includes a solenoid, there being an electrical connection to said solenoid and associated with said access opening for reception of electrical power via said access opening, for operating the solenoid to unblock said vertical movement of the storage chamber.

18. The combination of claim 15 wherein said latch means includes a solenoid, and including coded input responsive circuitry operatively connected in series with the solenoid to enable electrical operation of the solenoid only after predetermined electrically coded input to said circuitry.

* * * * *